US012312818B2

(12) United States Patent
Gasperich et al.

(10) Patent No.: US 12,312,818 B2
(45) Date of Patent: May 27, 2025

(54) ADHESIVE ANCHORING OF SUBFLOOR

(71) Applicant: Connor Sports Flooring, LLC, Salt Lake City, UT (US)

(72) Inventors: Jason Gasperich, Salt Lake City, UT (US); Doug Grove, Salt Lake City, UT (US); Andrew Jones, Salt Lake City, UT (US)

(73) Assignee: Connor Sports Flooring, LLC, Salt Lake City, UT (US)

( * ) Notice: Subject to any disclaimer, the term of this patent is extended or adjusted under 35 U.S.C. 154(b) by 0 days.

(21) Appl. No.: 17/191,663

(22) Filed: Mar. 3, 2021

(65) Prior Publication Data

US 2021/0277669 A1 Sep. 9, 2021

Related U.S. Application Data

(60) Provisional application No. 62/985,729, filed on Mar. 5, 2020.

(51) Int. Cl.
*E04F 15/22* (2006.01)
*E04F 15/024* (2006.01)

(52) U.S. Cl.
CPC .. *E04F 15/02476* (2013.01); *E04F 15/02458* (2013.01); *E04F 15/22* (2013.01)

(58) Field of Classification Search
CPC ... E04F 15/22; E04F 15/225; E04F 15/02194; E04F 15/02476; E04F 15/02458; E04F 15/02464; E04F 15/0247; E04F 15/02494; E04F 2290/041; E04F 2290/044; E04D 2015/02055
See application file for complete search history.

(56) References Cited

U.S. PATENT DOCUMENTS

| | | | | |
|---|---|---|---|---|
| 1,599,745 A | | 9/1926 | Cinnamond | |
| 3,298,653 A | * | 1/1967 | Omholt | E04F 15/22 52/704 |
| 3,316,680 A | | 5/1967 | Chrastek | |
| 3,511,001 A | | 5/1970 | Morgan | |
| 4,258,516 A | | 3/1981 | Mori et al. | |
| 4,443,989 A | | 4/1984 | Silvey et al. | |
| 4,467,578 A | * | 8/1984 | Weinar | E04B 2/7457 52/745.1 |

(Continued)

FOREIGN PATENT DOCUMENTS

| | | | | |
|---|---|---|---|---|
| CA | 2166759 | | 8/1996 | |
| CN | 109577600 A | * | 4/2019 | E04F 15/02044 |

(Continued)

OTHER PUBLICATIONS

International Search Report for Serial No. PCT/US21/20895 dated Jun. 23, 2021, 3 pages, United States.

*Primary Examiner* — Kyle J. Walraed-Sullivan
(74) *Attorney, Agent, or Firm* — Thorpe North & Western, LLP; Peter M. de Jonge; Kurt Hendricks

(57) ABSTRACT

A subfloor and subfloor anchoring system are disclosed, including a subfloor anchor adhesively attached to a slab. The subfloor anchor can include an anchor base and an anchor pin, with the anchor base adhesively attached to the slab, and the anchor pin attached to the anchor base and advanceable towards the anchor base. The anchor pin contacts an upper surface of a subfloor component and to anchor the subfloor to the slab.

19 Claims, 14 Drawing Sheets

(56) References Cited

U.S. PATENT DOCUMENTS 4,860,516 A * 8/1989 Koller ..... A63C 19/00 52/480
5,388,380 A * 2/1995 Niese ..... E04F 15/22 52/480
5,412,917 A * 5/1995 Shelton ..... E04F 15/22 52/480
5,465,548 A * 11/1995 Niese ..... E04F 15/22 29/897.3
5,501,754 A 3/1996 Hiraguri
5,609,000 A * 3/1997 Niese ..... E04F 15/22 52/480
6,158,185 A * 12/2000 Counihan ..... E04F 15/225 52/480
6,164,031 A * 12/2000 Counihan ..... E04F 15/02 52/489.1
RE37,615 E * 4/2002 Niese ..... E04F 15/22 52/480
6,363,675 B1 * 4/2002 Shelton ..... E04F 15/225 52/302.1
6,367,217 B1 4/2002 Niese et al.
6,584,745 B1 * 7/2003 Johansson ..... E04F 13/0807 248/188.4
7,980,040 B2 * 7/2011 Pacione ..... E04B 1/28 52/584.1
8,656,671 B1 * 2/2014 Chambers ..... E04F 13/0833 52/302.1
8,955,279 B1 * 2/2015 Clairmont ..... E04F 15/22 52/480
9,970,200 B1 * 5/2018 Malfatti ..... E04B 5/48
2002/0189184 A1 * 12/2002 Shelton ..... E04F 15/225 52/480
2004/0040242 A1 * 3/2004 Randjelovic ..... E04F 15/225 52/404.1
2004/0098926 A1 * 5/2004 Haytayan ..... B25C 1/188 52/40
2004/0098927 A1 * 5/2004 Haytayan ..... B25C 1/188 52/40
2004/0154240 A1 8/2004 Hiraguri et al.
2004/0237452 A1 * 12/2004 Niese ..... E04F 15/22 52/698
2005/0193660 A1 9/2005 Mead
2007/0107199 A1 5/2007 Haytayan
2009/0019805 A1 * 1/2009 Zanelli ..... E04F 15/02 52/489.1
2010/0205885 A1 * 8/2010 Randjelovic ..... E04F 15/02 52/403.1
2013/0008741 A1 * 1/2013 Kim ..... E04F 15/225 181/290
2020/0386000 A1 * 12/2020 Randjelovic ..... E04F 15/225
2021/0230885 A1 * 7/2021 Randjelovic ..... E04F 15/225

FOREIGN PATENT DOCUMENTS

| | | |
|---|---|---|
| EP | 123875 | 11/1984 |
| EP | 250255 | 12/1987 |
| EP | 295905 | 12/1988 |
| EP | 466625 | 1/1992 |
| EP | 473579 | 3/1992 |
| EP | 686738 | 12/1995 |
| EP | 1171678 | 1/2002 |
| EP | 1568829 | 8/2005 |
| FR | 2317433 | 2/1977 |
| GB | 1556361 | 11/1979 |
| JP | 10-299225 | 11/1998 |
| JP | 2003035028 | 2/2003 |
| JP | 2007186961 | 7/2007 |
| KR | 10-1081957 | 11/2011 |
| WO | WO 200711179 | 1/2007 |

* cited by examiner

ADHESIVE ANCHORING OF SUBFLOOR

PRIORITY CLAIM(S)

Priority is claimed to U.S. Provisional Patent Application Ser. No. 62/985,729, Filed Mar. 5, 2020, which is hereby incorporated herein by reference.

FIELD OF THE TECHNOLOGY

The present technology relates to subfloors for athletic surfaces and more particularly to systems and methods for anchoring subfloors.

BACKGROUND OF THE TECHNOLOGY AND RELATED ART

Suspended flooring, including athletic and dance surfaces, often include a subfloor installed below the flooring surface. The subfloor provides a foundation for the flooring, and can also provide resiliency and other characteristics particularly important for a given application. The subfloor is often anchored to the surface below the subfloor, such as a slab of concrete. While various solutions exist for anchoring of subfloors, there remains a need for improved systems and methods.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology, they are therefore not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DETAILED DESCRIPTION

Figure 1:
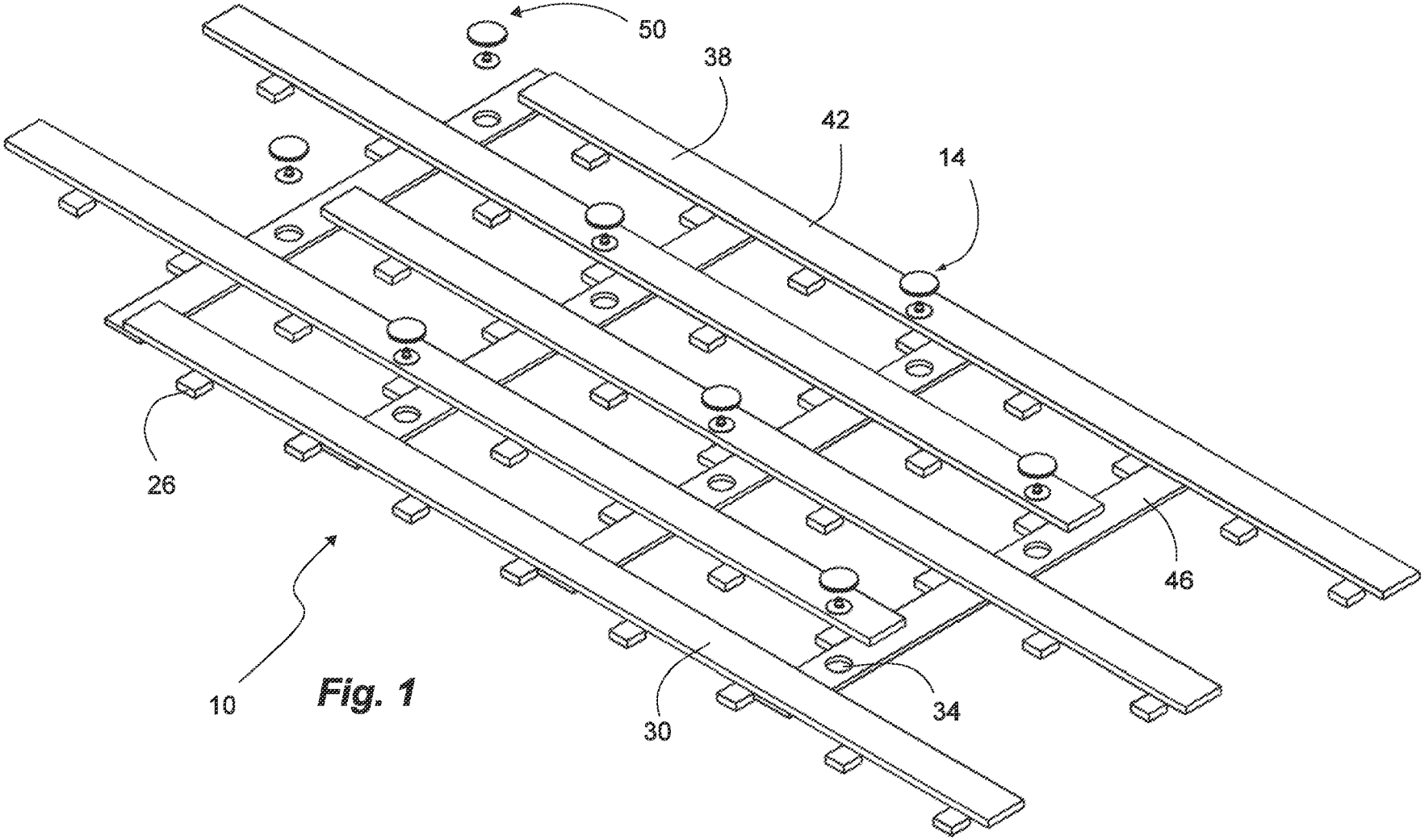
FIG. 1 is a perspective view of a subfloor with a subfloor anchor system in accordance with one aspect of the technology.
Figure 2:
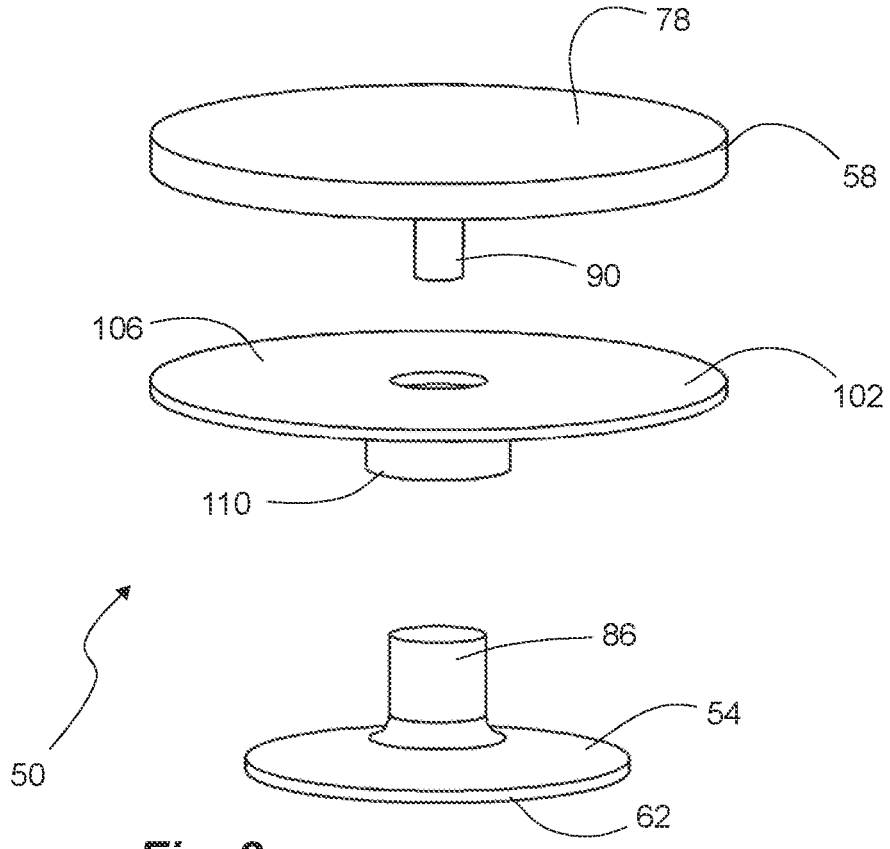
FIG. 2 is an exploded perspective view of a subfloor anchor of FIG. 1 in accordance with one aspect of the technology.
Figure 3:
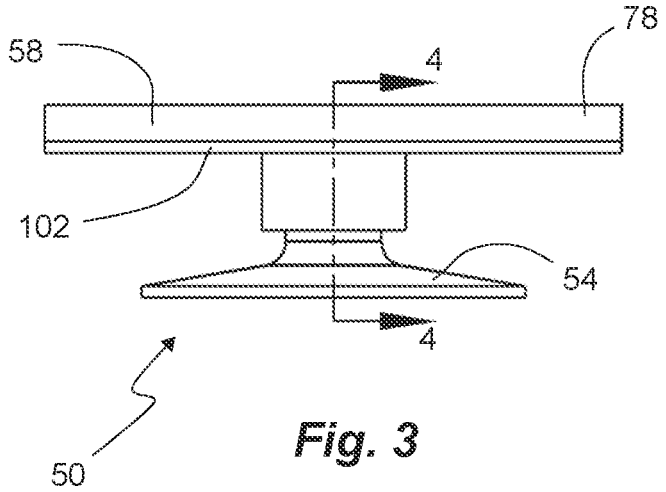
FIG. 3 is a side view of the anchor of FIG. 2.
Figure 4:
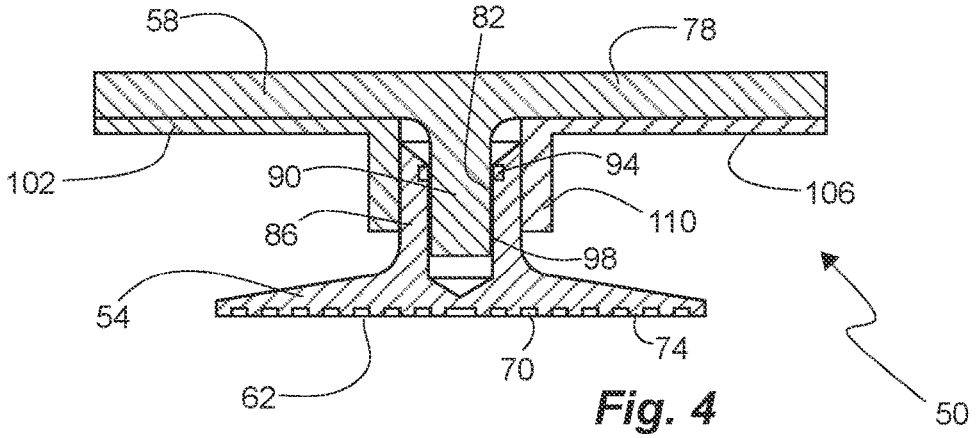
FIG. 4 is a cross-section side view the anchor of FIG. 2, along line 4 of FIG. 3.
Figure 5:
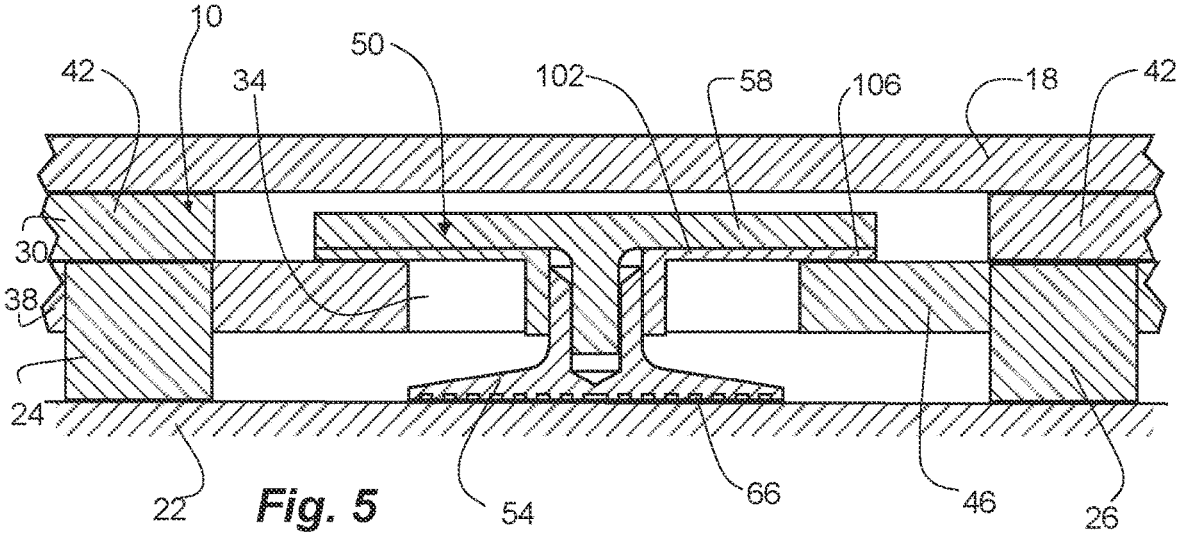
FIG. 5 is a cross-sectional side schematic view of the subfloor and the anchor system of FIG. 1.
Figure 6:
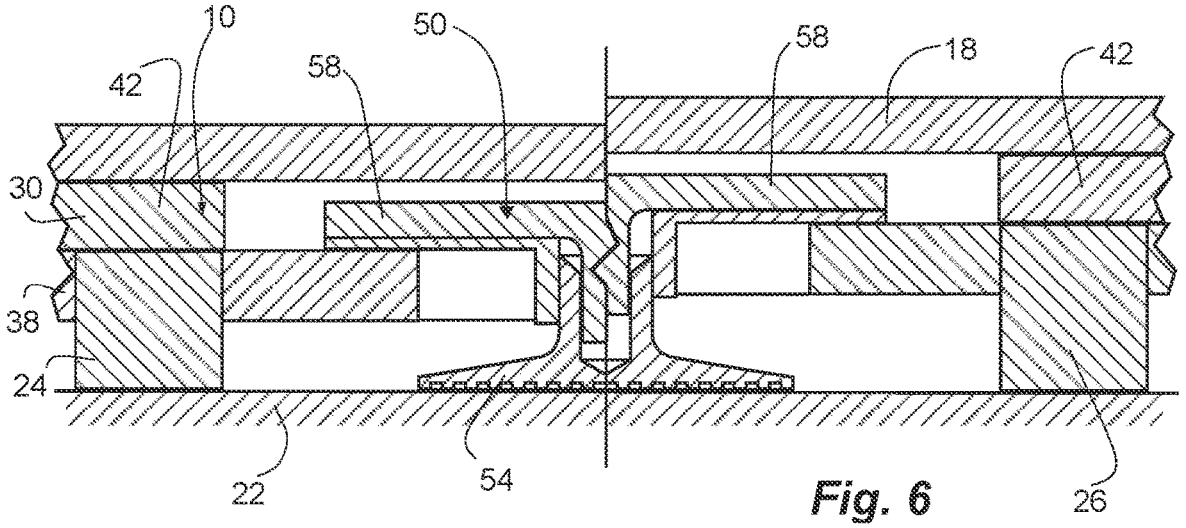
FIG. 6 is a cross-sectional side schematic view of the subfloor and the anchor system of FIG. 1, showing flooring at different elevations with respect to a slab.
Figure 7:
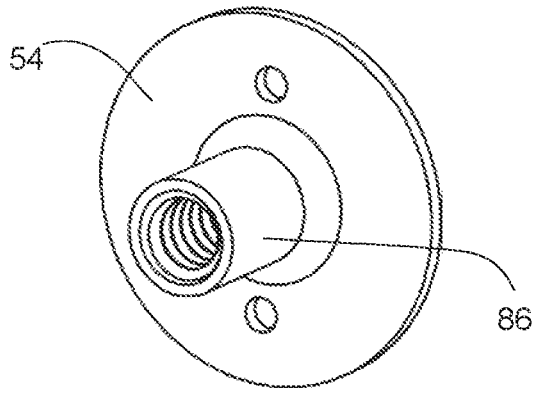
FIG. 7 is a perspective view of an anchor base of the anchor of FIG. 2.
Figure 8:
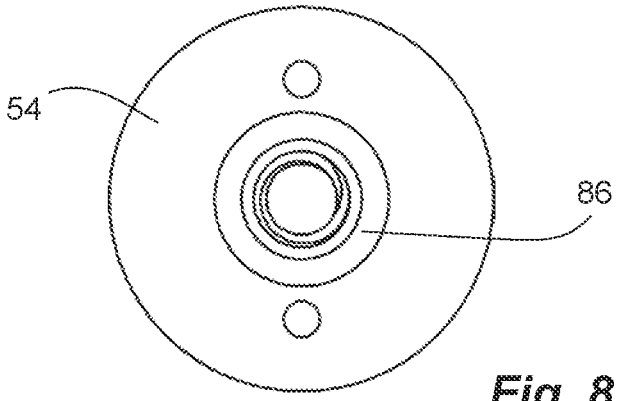
FIG. 8 is a top view of the anchor base of the anchor of FIG. 2.
Figure 9:
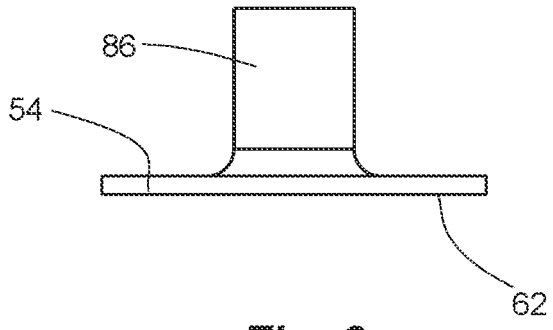
FIG. 9 is a side view of the anchor base of the anchor of FIG. 2.
Figure 10:
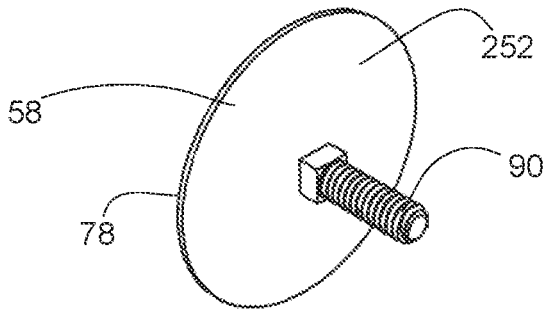
FIG. 10 is a perspective view of an anchor pin of the anchor of FIG. 2.
Figure 11:
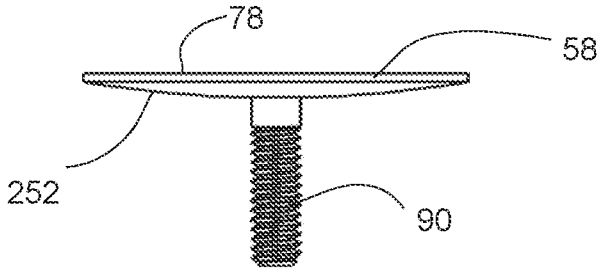
FIG. 11 is a side view of the anchor pin of the anchor of FIG. 2.
Figure 12:
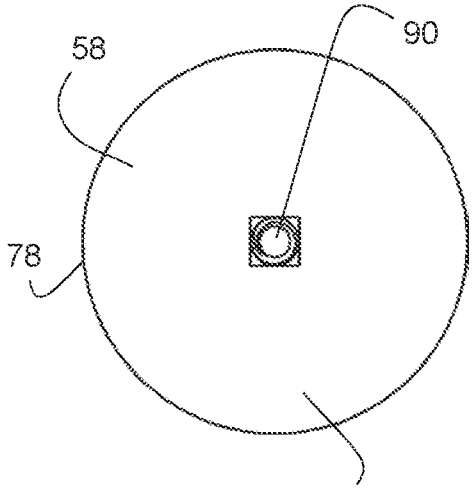
FIG. 12 is a bottom view of the anchor pin of the anchor of FIG. 2.
Figure 13:
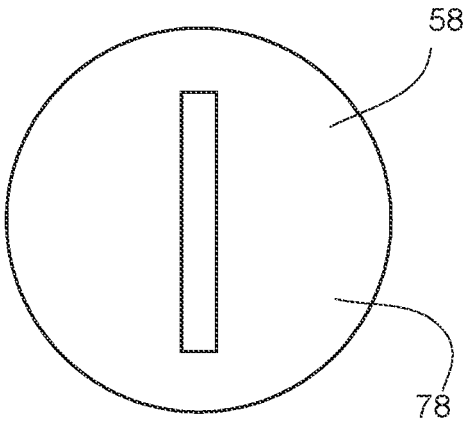
FIG. 13 is a top view of the anchor pin of the anchor of FIG. 2.
Figure 14:
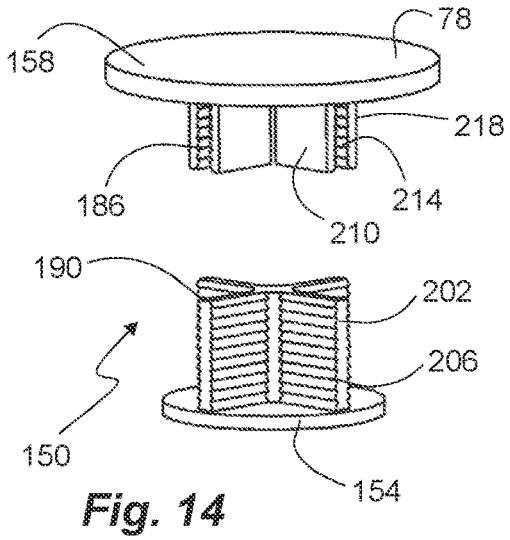
FIG. 14 is an exploded perspective view of another adhesive anchor in accordance with one aspect of the technology.
Figure 15:
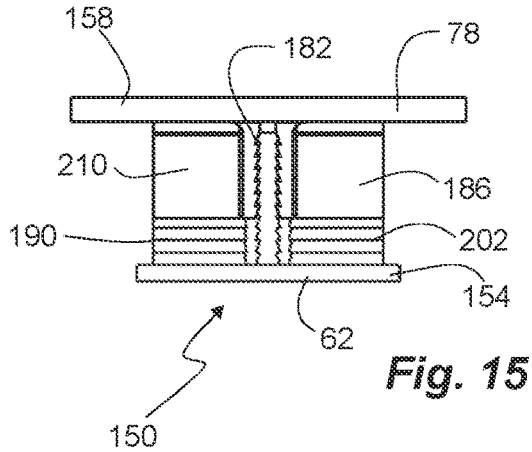
FIG. 15 is a side view of the anchor of FIG. 14.
Figure 16:
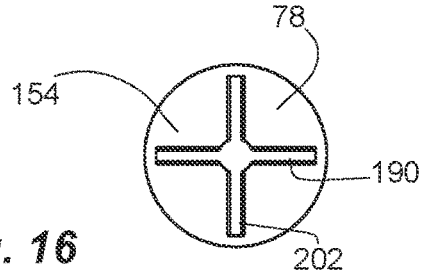
FIG. 16 is a top view of an anchor base of the anchor of FIG. 14.
Figure 19:
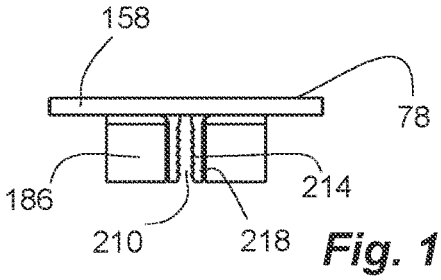
FIG. 19 is a side view of an anchor pin of the anchor of FIG. 14.
Figure 17:
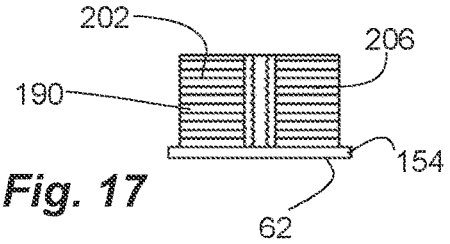
FIG. 17 is a side view the anchor base of the anchor of FIG. 14.
Figure 20:
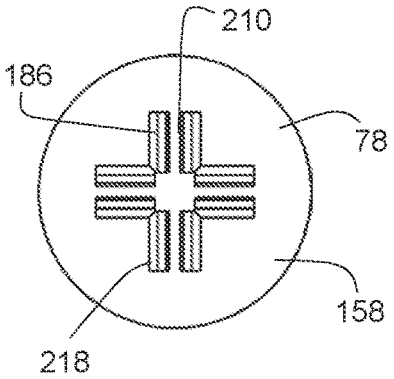
FIG. 20 is a bottom view of the anchor pin of the anchor of FIG. 14.

The following detailed description of exemplary aspects of the technology makes reference to the accompanying drawings, which form a part hereof and in which are shown, by way of illustration, exemplary aspects in which the technology may be practiced. While these exemplary aspects are described in sufficient detail to enable those skilled in the art to practice the technology, it should be understood that other aspects may be realized and that various changes to the technology may be made without departing from the spirit and scope of the present technology. Thus, the following more detailed description of the aspects of the present technology is not intended to limit the scope of the technology, as claimed, but is presented for purposes of illustration only and not limitation to describe the features and characteristics of the present technology and to sufficiently enable one skilled in the art to practice the technology. Accordingly, the scope of the present technology is to be defined solely by the appended claims.

The following detailed description and exemplary aspects of the technology will be best understood by reference to the accompanying drawings, wherein the elements and features of the technology are designated by numerals throughout.

The present technology describes an improved subfloor and subfloor anchoring system. Traditionally, subfloors are anchored into concrete slabs by driving an anchor into the concrete. Such an anchor pierces the concrete, then provides a permanent anchor onto which a variety of subfloors may be attached. However, various surfaces beneath subfloors, including concrete slabs, may include characteristics that prevent or disincentivize piercing the surface. For example, various concrete slabs are treated with surface treatments, including topical vapor retarders, vapor barriers or other concrete protection products. In some instances, driving an anchor into the slab could pierce the surface treatment and could lead to problems, including voiding the warranty of such treatments and surfaces. In other instances, the surface beneath the subfloor may be irreparably damaged by drilling into it, such as a pre-stressed concrete slab. In yet other instances, the slab may include components, such as heating tubes, which can be damaged and thus prevent pierced anchorage. Accordingly, there is a need for a subfloor anchoring system that does not pierce the surface below the subfloor.

The present technology relates to a subfloor and subfloor anchoring system that includes an adhesive anchor. The adhesive anchor may replace piercing anchors currently used, which require either drilling of holes into or direct insertion into a slab beneath a subfloor. In accordance with an aspect of the technology, the adhesive anchor can comprise an anchor pin engaging an anchor base. The adhesive anchor and the anchor base can be attached to the slab using an adhesive, and the anchor pin can be attached to the subfloor, securing the subfloor to the slab. Thus, the subfloor and the subfloor anchoring system resists piercing topical vapor retarders, damaging pre-stressed concrete and puncturing heated tubes in the slab. In addition, the subfloor and the subfloor anchoring system can reduce sound transmission because the adhesive can act as a sound insulator between the adhesive anchor and the slab. In another aspect, the anchor pin can be advanced towards the anchor base until reaching a desired elevation of the subfloor with respect to the slab. In one aspect, a distance between the anchor pin and the anchor base can be varied to account for an unlevel surface of the slab. In another aspect, advancing the anchor pin towards the anchor base can compress a resilient layer, such as resilient pads, between the subfloor and the slab. Adjusting a distance between the anchor pin and the anchor base can pretension the resilient pads.

Referring to FIGS. 1-12, a subfloor 10 and a subfloor anchoring system 14 in accordance with aspects of the technology are shown. The subfloor 10 can support and carry flooring 18 with respect to a support surface, such as a slab 22. In one aspect, the slab 22 can be a concrete pad. The slab 22 may have macroscopic surface irregularities such that portions of the upper surface of the slab being irregular or unlevel. In another aspect, the flooring 18 can comprise wood or a laminate including wood. The flooring 18 can be a solid and continuous layer. The flooring 18 can have an uppermost exposed surface forming and defining a finished surface, such as a dance floor or sport court. In one aspect, the finished surface can comprise a stain to highlight the wood grain and a clear protectant so that the wood grain is visible therethrough. In another aspect, the finished surface can also comprise paint, such as lines and indicia indicative of a sport, and also covered with a clear protectant to that the lines and indicia are visible therethrough.

The subfloor 10 can comprise a resilient layer 24 between the slab 22 and the subfloor 10. The resilient layer can be positioned on or over the slab 22. In one aspect, the resilient layer 24 can be a substantially continuous layer. In another aspect, the resilient layer 24 can comprise a matrix of resilient pads 26 positioned on or over the slab 22. The pads 26 can be positioned in a regular pattern forming the matrix. In one aspect, the resilient layer 24 or the resilient pads 26 can be compressible between the subfloor 10 and the slab 22. In another aspect, another layers, such as a vapor barrier can be located on the slab 22 and positioned between the resilient layer 24 or the matrix of resilient pads 26 and the slab 22.

The subfloor 10 can further comprise a frame 30 carried by the resilient layer 24 or the matrix of resilient pads 26. The frame 30 can be suspended above the slab 22 by the resilient layer 24 or the matrix of resilient pads 26. In one aspect, the frame 30 can comprise wood or a laminate including wood. In one aspect, the frame 30 can comprise a substantially solid and continuous layer. Openings, such as apertures 34, can be formed in and through the frame 30 to anchor the subfloor 10 to the slab 22. In one aspect, the apertures 34 can be circular or round, and can be formed by drilling. In another aspect, the apertures 34 can be surrounded on all sides by the frame 30. In another aspect, the apertures 34 can be oblong, such as oval or rectangular, to allow a degree of lateral movement or play, and/or to allow expansion and contraction of the subfloor 10.

In another aspect, the frame 30 can comprise a lattice 38 carried by the resilient layer 24 or the matrix of resilient pads 26. The lattice 38 can comprise slats or cross-arms. An array of upper cross-arms 42 can be carried by the resilient layer 24 or the matrix of resilient pads 26, and suspendable above the slab 22 by the resilient layer 24 or the matrix of resilient pads 26. The flooring 18 can be carried by and positioned on the lattice 38 and the frame 30. An array of lower cross-arms 46 can be coupled to and suspended from the array of upper cross-arms 42. The apertures 34 can be formed in the lower cross-arms 46. In one aspect, the array of upper cross-arms 42 can be oriented transverse to the array of lower cross-arms 46, forming the lattice 38. In another aspect, an array of upper arms can be parallel with an array of lower arms, as described below. In one aspect, the slats or cross-arms can comprise wood. In one aspect, the upper and lower cross-arms can be secured together with adhesive and/or fasteners.

The subfloor 10 and the subfloor anchor system 14 can comprise adhesive anchors 50 located in the apertures 34. Thus, the adhesive anchors 50 can be arranged in a matrix. Each adhesive anchor 50 can comprise an anchor base 54 and an anchor pin 58 engaging one another and movable with respect to one another. In one aspect, the adhesive anchors 50, and one or both of the anchor base 54 and/or the anchor pin 58, can be formed of plastic or metal.

Figure 18:
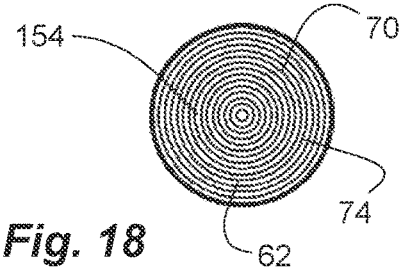
FIG. 18 is a bottom view of the anchor base of the anchor of FIG. 14.

The anchor base 54 has a bottom surface 62 to receive an adhesive 66 to adhere the anchor base 54 to the slab 22. The bottom surface 62 of the anchor base 54 can be broad and wide, and can indentations and/or protrusions to increase the surface area for the adhesive 66. The bottom surface 62 of the anchor base 54 can have a series of concentric annular grooves 70 and concentric annular protrusions 74 (FIG. 18) to receive adhesive therein. The grooves 70 and protrusions 74 increase the surface area of the bottom surface 62 to which the adhesive can adhere. The anchor base 54 can have lateral dimensions, such as width or diameter, less than lateral dimension of a respective aperture 34, such as width or diameter, so that the anchor base 54 can be insertable through the respective aperture 34 during installation.

The anchor pin 58 is received by the anchor base 54. The anchor pin 58 can have an enlarged head 78 with a dimension, such as width or diameter, larger than a respective aperture 34. Thus, the enlarged head 78 can resist passing through aperture 34 and can abut to or bear against the frame 30 or the lower cross-arm 46 of the lattice 38. In one aspect, the enlarged head 78 of the anchor pin 58 can be larger, e.g. can have a greater diameter, than the anchor base 54.

In one aspect, the adhesive anchor 50 can also comprise a threaded engagement 82 between the anchor pin 58 and the anchor base 54, with one of the anchor base and the anchor pin having a threaded receiver 86, and the other of the anchor base and the anchor pin having a threaded insert 90. The anchor pin 58 can rotationally engage the anchor base 54. In one aspect, the anchor base 54 can have the threaded receiver 86 and the anchor pin 58 can have the threaded insert 90, as shown in FIGS. 4 and 7-12. In another aspect, the anchor base can have the threaded insert and the anchor pin can have the threaded receiver. The bottom surface 62 of the anchor base 54 can be broader and wider than the threaded engagement 82, or the threaded receiver 86 and the threaded insert 90, to provide surface area for the adhesive 66.

In one aspect, the head 78 of the anchor pin 58 can have a slot to facilitate rotation. In another aspect, a locking mechanism 94 can be associated with the threaded engagement 82 to resist undesired or unintentional rotation between the anchor pin 58 and the anchor base 54. The locking mechanism can be or can include a lock washer, a deformable ring, or a threadlock compound. In another aspect, the adhesive anchor 50 can further comprise an insert, a coating or a thin tube 98 located between the threaded receiver 86 and the threaded insert 90 to lock rotation and/or suppress noise.

In another aspect, the adhesive anchor 50 can further comprise a gasket 102 positioned between the anchor pin 58 and the frame 30 or the lower cross-arm 46 of the lattice 38. The gasket 102 can resist noise, such as squeaking, between the adhesive anchor 50 and the frame 30 or lattice 38, such as during any movement or expansion/contraction of the subfloor 10 about the adhesive anchor 50. In one aspect, the gasket 102 can comprise a radial flange 106 with at least a portion located between the enlarged head 78 of the anchor pin 58 and the frame 30 or the lower cross-arm 46 of the lattice 38. In another aspect, the gasket 102 can comprise an axial sleeve 110 surrounding at least a portion of anchor pin 58, and the threaded engagement 82, and located in a respective aperture 34 in the frame 30 or the lower cross-arm 46. In one aspect, the gasket 102 can comprise rubber. In one aspect, the gasket 102 or the axial sleeve 110 can be sized to fill the aperture 34 to resist movement. In another aspect, the gasket 102 or the axial sleeve 110 can be sized larger than the aperture 34 to form a press-fit or interference fit to further resist movement. In another aspect, the gasket 102 or the axial sleeve 110 can be sized smaller than the aperture 34 to allow a certain degree of movement.

In use, a method of anchoring the subfloor 10 with the adhesive anchor system 14 can comprise positioning the resilient layer 24 on or over the slab 22. In one aspect, the matrix of resilient pads 26 can be positioned on or over the slab 22. In another aspect, a vapor barrier can be placed on the slab, and thus between the resilient layer 24 and the slab. The frame 30 or the lattice 38, with the upper and lower cross-arms 42 and 46, can be placed on the resilient layer 24 or resilient pads 26 and over the slab 22. In one aspect, the lattice 38 can be placed on or over the slab 22 and the resilient pads 26 can be positioned under the lattice 38 via the spaces between the cross-arms 42 and 46. Adhesive 66 can be applied to the bottom surface 62 of the anchor base 54 of the adhesive anchor 50. The anchor base 54, with the adhesive 66 thereon, can be inserted through the corresponding aperture 34 in the frame 30 or the lower cross-arm 46 of the lattice 38. Applying adhesive and inserted anchor bases can be repeated for all of the adhesive anchors and corresponding apertures. In one aspect, just the anchor base 54 can be inserted into and through the aperture 34, and then the anchor pin 58 can be inserted into the aperture 34 and engaged with and attached to the anchor base 54. In another aspect, the anchor pin 58 can be engaged with the anchor base 54, and then adhesive 66 can be applied to the anchor base 54 and the adhesive anchor 50 can be inserted into the aperture 34. The adhesive 66 on the bottom surface 62 of the anchor base 54 can be adhered to the slab 22. In one aspect, the anchor base 54 or the adhesive anchor 50 can be pressed against the slab 22 and the adhesive 66 forced into contact with the slab 22 and into the annular grooves 70 of the anchor base 54.

As described above, the anchor pin 58 can be attached to the anchor base 54 if not already attached. The anchor pin 58 can be advanced towards the anchor base 54, with the enlarged head 78 pressing against the frame 30 or the lower-cross arm 46 of the lattice 38 and compressing the resilient layer 24 or resilient pads 26 adjacent the adhesive anchor 50, until reaching a desired elevation of the frame 30 or the upper cross-arm 42 of the lattice 38 with respect to the slab 22 is achieved. Advancing the anchor pin 58 can reduce a height of the adhesive anchor 50, and thus a height or thickness of the subfloor 10 adjacent the adhesive anchor 50. In one aspect, the anchor pin 58 can be advanced towards the anchor base 54 by rotating the anchor pin 58 and the threaded engagement 82, with the threaded insert 90 advancing in the threaded receiver 86.

In one aspect, the resulting subfloor 10 can comprise the resilient layer 24 extending across the slab 22 and supporting the frame 30, with subfloor anchor system 14 comprising a matrix of adhesive anchors 50 extending through a matrix of apertures 30 and adhered to the slab 22 and fixing the frame 30 to the slab 22. In another aspect, the resulting subfloor 10 can comprise the matrix of resilient pads 26 extending across the slab 22 and supporting the lattice 38, and the upper cross-arms 42 thereof, with subfloor anchor system 14 comprising a matrix of adhesive anchors 50 extending through a matrix of apertures 30 and adhered to the slab 22 and fixing the lattice 38, and the lower cross-arms 46 thereof, to the slab 22. The subfloor 10 can receive the flooring 18 thereon, and can carry the flooring 18 with respect to the slab 22. Thus, the flooring 18 can be supported above the slab 22 by the subfloor 10 and the subfloor anchor system 14. The adhesive 66 being between each bottom surface 62 of each anchor base 54 and the slab 22, and adhering the frame 30 of the lattice 38 to the slab 22 via the adhesive anchors 50. The frame 30 or the lattice 38 can be carried on the slab 22 by the resilient layer 24 or the resilient pads 26. The elevation of the upper surface of the frame 30 or the upper-cross members 42 of the lattice 38 with respect to the slab 22 around each adhesive anchor 50 can be set or determined by the corresponding adhesive anchor 50. Similarly, the thickness of the subfloor 10 adjacent each adhesive anchor 50 can be set or determined by the corresponding adhesive anchor 50.

In one aspect, the adhesive 66 can comprise a permanent or semi-permanent adhesive. The anchor base 54 can be permanently attached to the slab 22, while the anchor pin 54 can be removed to remove the frame 30 or lattice 38 and install another frame or lattice using the same anchor base 50. In another aspect, the anchor base 54 may be removed, for example, by using a chemical compound to release the adhesive 66 between the anchor base 54 and the slab 22.

In one aspect, the amount of adhesive 66 applied to the anchor base 54 can be metered to ensure that an accurate and consistent amount is applied. For example, a tool may be used to apply a set amount of adhesive 66 to each anchor base 54. In another aspect, an individual packet of adhesive 66 can be pre-measured and applied to each anchor base 54 prior to installation.

In another aspect, the subfloor 10 and/or the slab 22 can further comprise a polyethylene vapor barrier covering the slab 22. To maintain the vapor barrier properties, holes can be cut into the barrier that are sized slightly smaller than the anchor base 54 or bottom surface 62 thereof. Thus, the anchor base 54 can be adhere to the slab 22, while also maintaining the vapor barrier as continuous and uninterrupted to maintain high moisture barrier capability. In one aspect, a tool can be used to quickly and easily cut a hole in the vapor barrier of the correct size. For example, a circular hole saw bit can be used in a power drill. In other aspect, a circular pivot of the desired size can have a small piercing blade about the circumference of the pivot, and the blade can be run around the circumference to cut the hole in the barrier.

Referring to FIGS. 14-20, another adhesive anchor 150 in accordance with an aspect of the technology is shown which is similar in structure and function to the above description, and which description is hereby incorporated herein. The adhesive anchor 150 can comprise a mating saw-tooth engagement 182 between the anchor pin 158 and the anchor base 154. One of the anchor base 154 and the anchor pin 158 can have a ridged receiver 186 that is flexible and resilient. The other of the anchor base 154 and the anchor pin 158 can have a ridged insert 190. The anchor pin 158 and the anchor base 154, and the ridged receiver 186 and the ridged insert 190, can engaging linearly.

The ridged insert 190 can have vertical tabs 202 arranged radially and radiating outwardly with respect to a center. In one aspect, the vertical tabs 202 can comprise a pair of tabs intersecting one another in a cross, or four tabs arranged in a cross. Each vertical tab 202 can have a series of ridges 206 with an inclined surface facing upwardly, and an opposite blunt surface facing downwardly.

The ridged receiver 186 can have vertical slots 210 arranged radially and radiating outwardly with respect to a center. The vertical slots 210 correspond to the vertical tabs 202 of the ridged insert 190. Thus, in one aspect, the vertical slots 210 can comprise four slots arranged in a cross. Each vertical slot 210 can have a series of ridges 214 with an inclined surface facing downwardly, and an opposite blunt surface facing upwardly. Thus, the inclined surfaces can engage and facilitate insertion of the insert 190 into the receiver 186, while the blunt surfaces can engage and resist withdrawal of the insert 190 from the receiver 186. In addition, each vertical slot 210 can have opposing walls 218 that can be flexible and resilient to deflect outwardly to accommodate insertion of a corresponding vertical tab 202. Furthermore, a width or thickness of the tabs 202 at peaks of the ridges 206 can be greater than a width or thickness of the slots 210 at peaks of the ridges 214. Thus, the opposing walls 218 can deflect outwardly as the inclined surfaces engage, and retract when the ridges 206 of the tab 202 match and mate with the ridges 214 of the slot 210. In one aspect, the adhesive anchor 150 or the anchor pin 158 or the ridged receiver 186 can be formed of nylon to allow flex and facilitate sliding. The anchor pin 158 can be advanced towards the anchor base 154 linearly, such as by pressing the anchor pin 158 towards the anchor base 154.

In one aspect, the anchor base 154 can have the tabs 202, while the anchor pin 158 can have the slots 210, as shown in FIGS. 14-20. In another aspect, the anchor base can have the slots and the anchor pin can have the tabs.

Referring again to FIG. 11, in another aspect, the enlarged head 78 of the anchor pin 58 can have an inner face 252 facing towards the anchor base 54, and thus towards the frame 30 or the lattice 38 and the radial flange 106 of the gasket 102. The inner face 252 can be inclined and facing axially and outwardly in a broad and flat frusto-conical shape. Thus, the enlarged head 78 can have a thicker center and a thinner perimeter. The inclined inner face 252 of the head 78 of the anchor pin 58 can act to compress the radial flange 106 of the gasket 102 in a radial direction.

Figure 21:
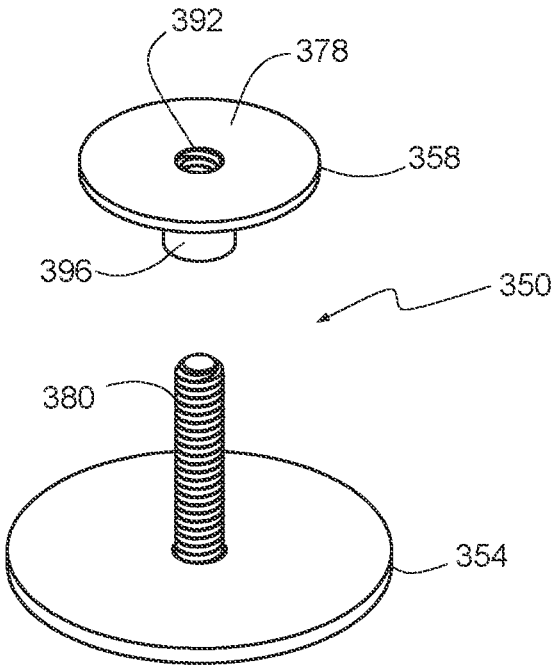
FIG. 21 is an exploded perspective view of another adhesive anchor in accordance with another aspect of the technology.
Figure 22:
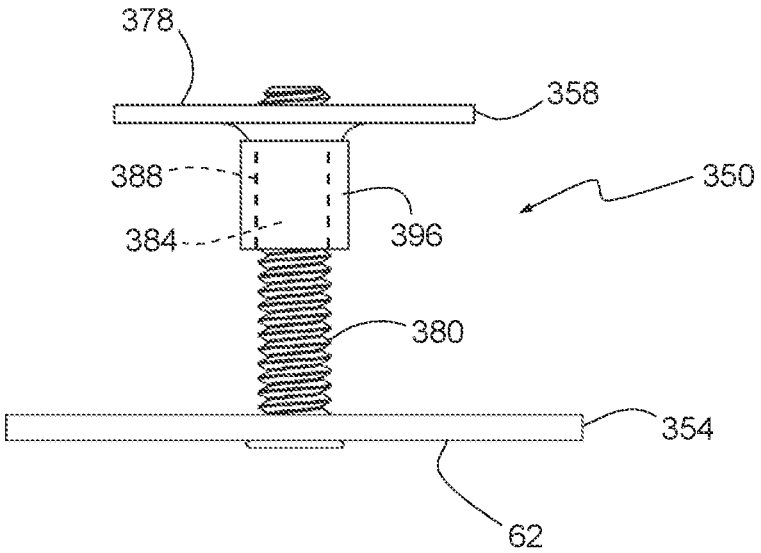
FIG. 22 is a side view of the adhesive anchor of FIG. 21.

Referring to FIGS. 21 and 22, another adhesive anchor 350 in accordance with an aspect of the technology is shown which is similar in structure and function to the above description, and which description is hereby incorporated herein. The anchor base 354 can have a threaded stud 380 extending therefrom defining a threaded insert, as described above. In one aspect, the anchor base 354 can comprise a washer with the threaded stud 380 press-fit into an aperture in the washer. A head of the stud 380 can be larger than the aperture in the washer. The anchor pin 358 can have a neck 384 or shank extending from the enlarged head 378. A threaded bore 388 can extend through the neck 384. In one aspect, the threaded bore 388 can also extend through the enlarged head 378, defining the threaded receiver. In addition, the threaded bore 388 extending through the enlarged head 378 can form an open top 392 to be engaged by a tool. The threaded stud 380 of the anchor base can be received in the threaded bore 388 of the anchor pin 358. In one aspect, a threadlock compound can be applied to the stud 380 to resist loosening of the threads after installation and during use of the subfloor. In one aspect, the bottom surface 62 of the anchor base 354 can be larger, e.g. can have a larger diameter, than the enlarged head 378 of the anchor pin 358. In another aspect, a sleeve 396 or bushing can be positioned on and circumscribe the neck 384 of the anchor pin 358. In another aspect, the sleeve 396 can be flexible and resilient to insulate against squeaks. For example, the sleeve 396 can comprise PVC tubing. In another example, the sleeve 396 can comprise rubber.

Figure 23:
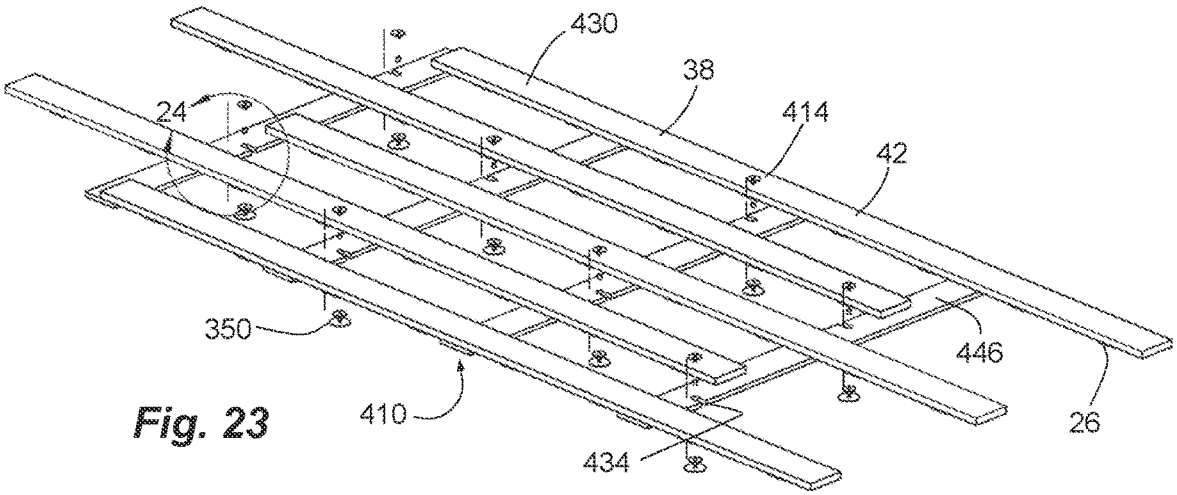
FIG. 23 is a perspective view of another subfloor with a subfloor anchor system in accordance with another aspect of the technology.
Figure 24:
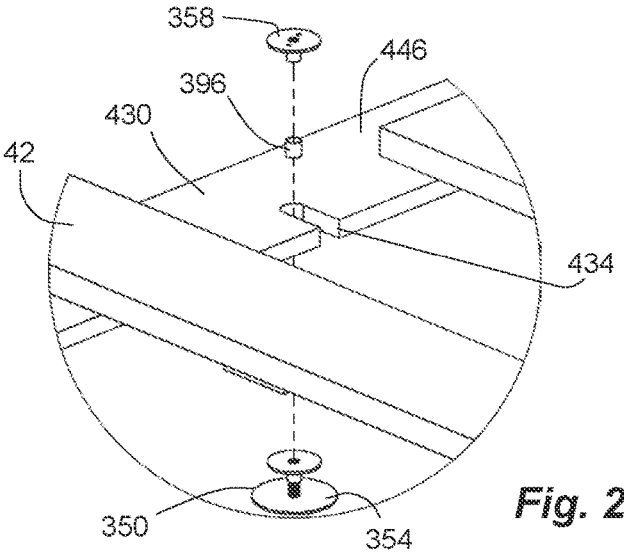
FIG. 24 is a detailed perspective view of the subfloor of FIG. 23.
Figure 25:
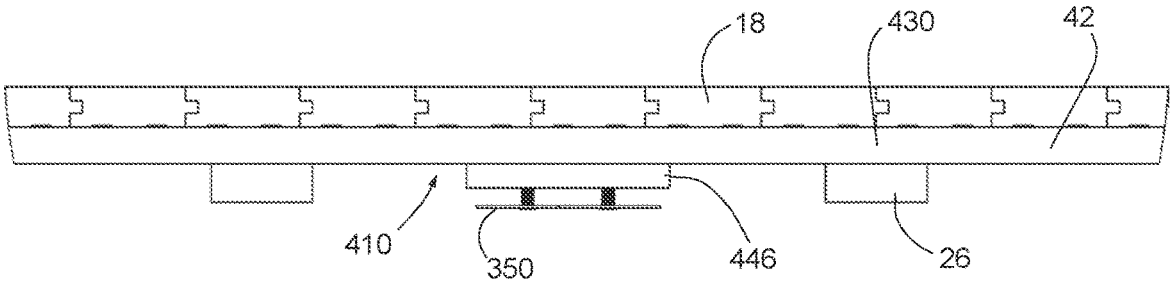
FIG. 25 is a side view of the subfloor of FIG. 23.

Referring to FIGS. 23-25, another subfloor 410 and another subfloor anchoring system 414 in accordance with an aspect of the technology are shown which are similar in structure and function to the above description, and which description is hereby incorporated herein. In one aspect, the subfloor anchoring system 414 can utilize adhesive anchors 350 as described above. The subfloor 410 can have openings, such as slots 434, in the frame 430, such as the lower cross-arms 446. Each slot 434 can extending into the frame 430 and the lower cross-arm 446 from a perimeter side of the frame 430 and lower cross-arm 446. Thus, the slot 434 is open laterally through the frame 430 and the lower cross-arm 446. The slot 434 can accommodate use of the adhesive anchor 350 with a larger bottom surface 62 because the anchor base 354 does not need to pass through an aperture in the frame 430 and the lower cross-arm 446. The adhesive anchor 350 can be placed alongside the frame 430 and the lower cross-arm 446 and the threaded connection of the threaded stud 380 and the neck 384 with the sleeve 396 slid into the slot 434.

The enlarged head 378 of the anchor pin 350 can have a lateral dimension, such as a diameter, that is larger than a width of the slot 434. The width can be oriented parallel with the opening to the slot and perpendicular to a direction into the slot. Thus, a portion of the frame 430 and the lower cross-arm 446, namely the lateral perimeter sides and the closed end of the slot 434, can be positioned between the enlarged head 378 of the anchor pin 358 and the anchor base 354. In one aspect, one slot 434 can extend into one side of the frame 430 and the lower cross-arm 446, and another slot 434 can extend into another opposite side of the frame 430 and the lower cross-arm 446. In another aspect, the slots 434 can alternate sides. Thus, although the slots 434 have an open end, the open ends of at least two slots 434 can face opposite directions to horizontally retain the frame 430 and the lower cross-arms 446. The sleeve 396 can be positioned in the opening between the neck 384 of the anchor pin 358 and the frame 430 and the lower cross-arms 446.

Figure 26:
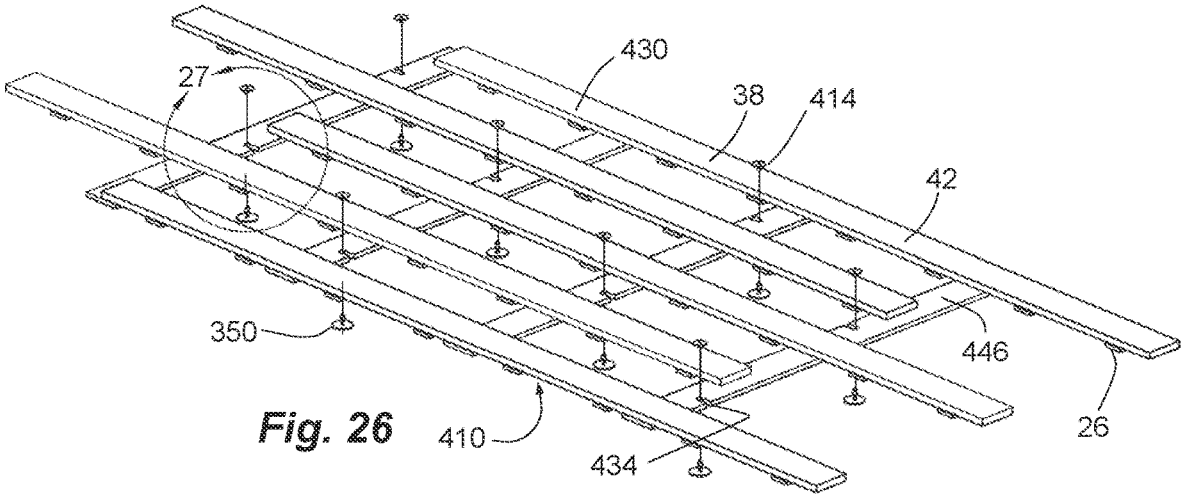
FIG. 26 is a perspective view of another subfloor with a subfloor anchor system in accordance with another aspect of the technology.
Figure 27:
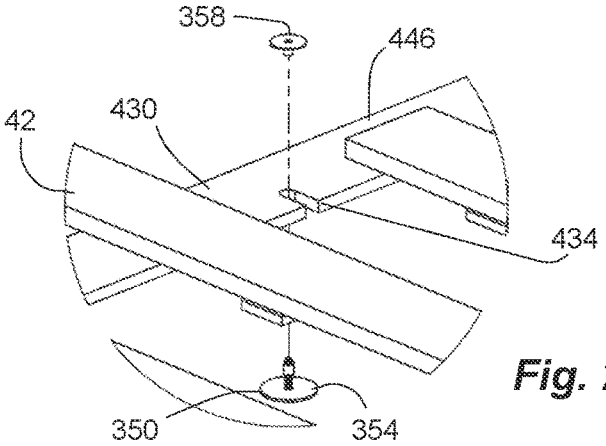
FIG. 27 is a detailed perspective view of the subfloor of FIG. 26.
Figure 28:
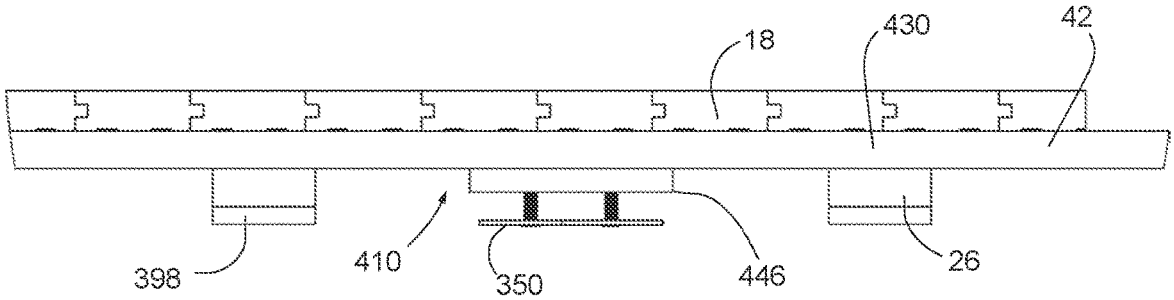
FIG. 28 is a side view of the subfloor of FIG. 27.

Referring to FIGS. 26-28, the subfloor 410 and the subfloor anchoring system 414 can accommodate various slab profiles. The subfloor anchoring system 414 and the adhesive anchors 350 can have threaded studs 380 of the adhesive bases 354 with various lengths to accommodate modifications to the subfloor 410 to allow installation in a facility where the slab depression is deeper than the standard slab. By way of example, a standard subfloor 410 can provide a 2¼" profile height. In one aspect, ⅜" or ½" profile blocks 398 can be added to increase the elevational height to accommodate a 2¾" profile height.

Figure 29:
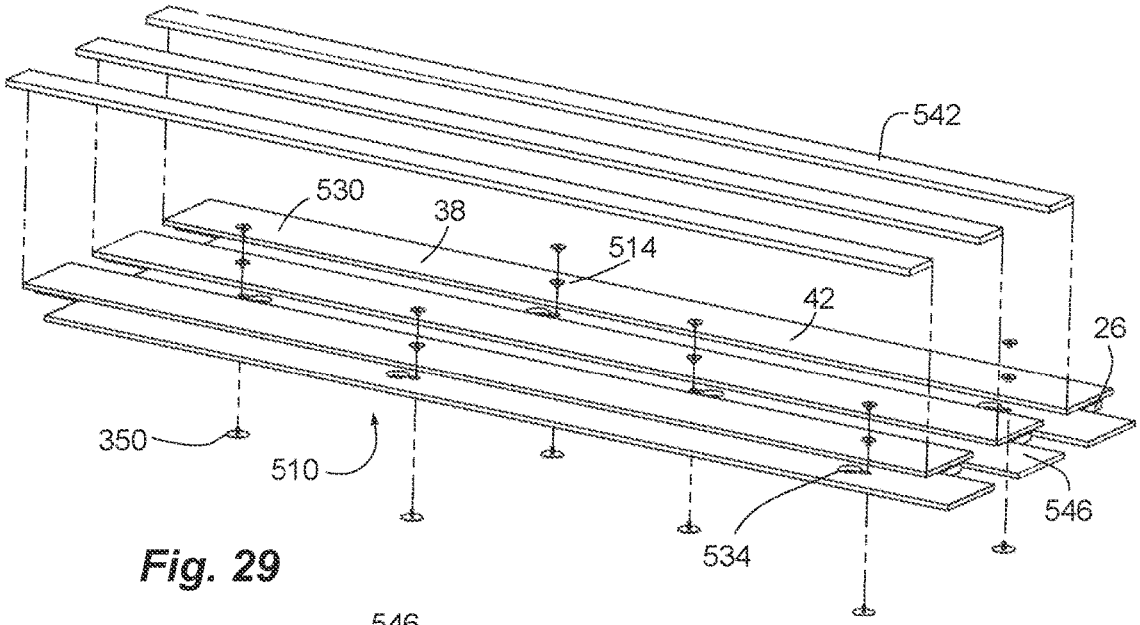
FIG. 29 is a perspective view of another subfloor with a subfloor anchor system in accordance with another aspect of the technology.
Figure 30:
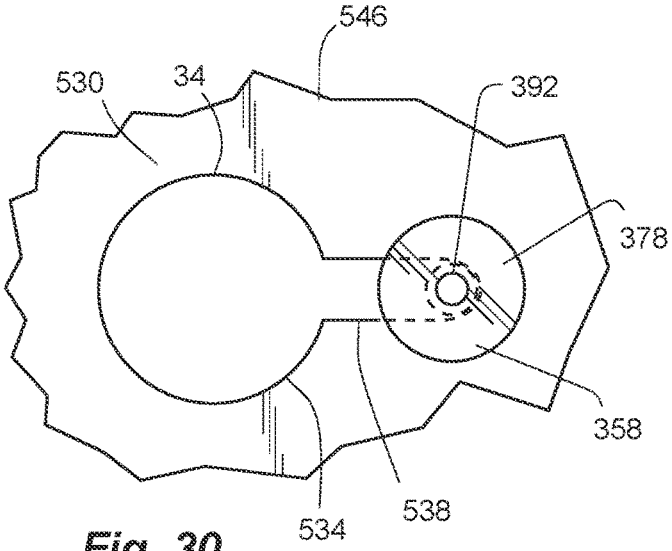
FIG. 30 is a detailed perspective view of the subfloor of FIG. 29.
Figure 31:
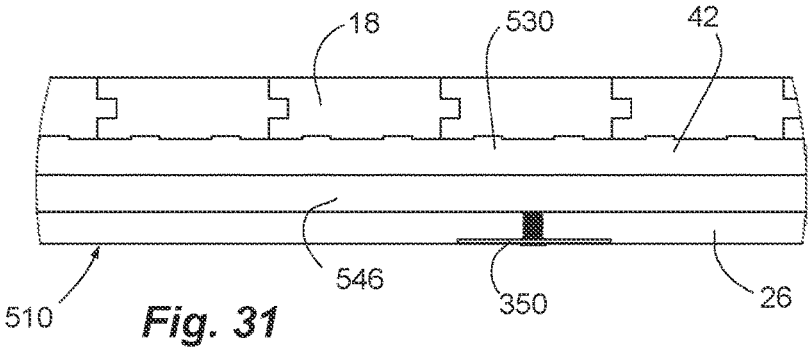
FIG. 31 is a side view of the subfloor of FIG. 29.

Referring to FIGS. 29-31, another subfloor 510 and another subfloor anchoring system 514 in accordance with an aspect of the technology are shown which are similar in structure and function to the above descriptions, and which descriptions are hereby incorporated herein. In one aspect, the subfloor anchoring system 514 can utilize adhesive anchors 350 as described above. The subfloor 510 can have openings, such as keyholes 534, in the frame 530, such as the lower arms or slats 546. Each keyhole 534 can have an aperture 34 and a slot 538 extending from the aperture 34. The slot 538 can have a width less than the lateral dimension or diameter of the aperture 34. Again, the width can be perpendicular to a direction into the slot. The aperture 34 can be sized to receive the anchor base 354 therethrough, as described above, while the slot 538 can be sized to receive the neck 384 and the sleeve 396 of the anchor pin 358. The adhesive anchor 350 can be inserted into the aperture 34 of the keyhole 534 of the frame 530 and the lower arm 546 and the threaded connection of the threaded stud 380 and the neck 384 with the sleeve 396 slid into the slot 538.

The enlarged head 378 of the anchor pin 358 can have a lateral dimension or diameter larger than the width of the slot 538. Thus, a portion of the frame 530 and the lower arm 546, namely the lateral perimeter sides and the closed end of the slot 538, can be positioned between the enlarged head 378 of the anchor pin 358 and the anchor base 354. In one aspect, one keyhole 534 can be oriented with a corresponding slot 538 extending one direction, and another keyhole 534 oriented with another corresponding slot 538 extending in another opposite direction. In another aspect, the orientation of the keyholes 534 can alternate between lower arms 546. Thus, although the slots 538 have an open end, the open ends of at least two slots 538 can face opposite directions to horizontally retain the frame 530 and the lower arms 546. Again, the sleeve 396 can be positioned in the opening between the neck 384 of the anchor pin 358 and the frame 530 and the lower arms 546.

In one aspect, the lower arms 546 and the upper arms 42 of the frame 510 can be oriented parallel with respect to one another. The lower arms 546 can be spaced-apart from one another, and the upper arms 42 can be spaced-apart from one another. Corrugated carpet pad 542 can be placed between the upper arms 42.

Figure 32:
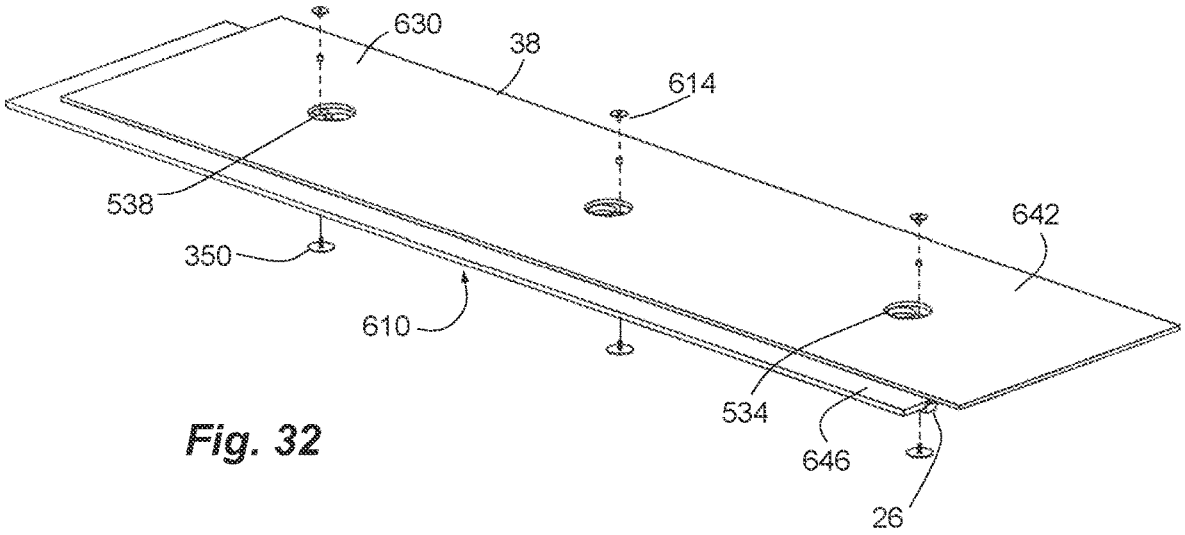
FIG. 32 is a perspective view of another subfloor with a subfloor anchor system in accordance with another aspect of the technology.
Figure 33:
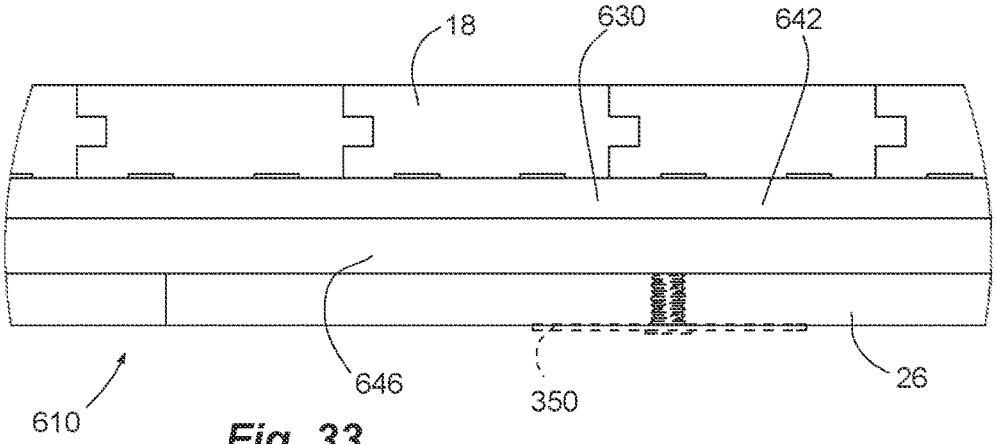
FIG. 33 is a side view of the subfloor of FIG. 32.

Referring to FIGS. 32-33, another subfloor 610 and another subfloor anchoring system 614 in accordance with an aspect of the technology are shown which are similar in structure and function to the above descriptions, and which descriptions are hereby incorporated herein. In one aspect, the subfloor anchoring system 614 can utilize adhesive anchors 350 as described above. The subfloor 610 can have openings, such as keyholes 534, in the frame 630, such as a lower panel 646. In another aspect, the orientation of the keyholes 534 can alternate between adjacent keyholes 534. In one aspect, an upper panel 642 can be positioned over the lower panel 646. The upper panel 642 can have apertures therethrough corresponding to the keyholes 534.

Figure 34:
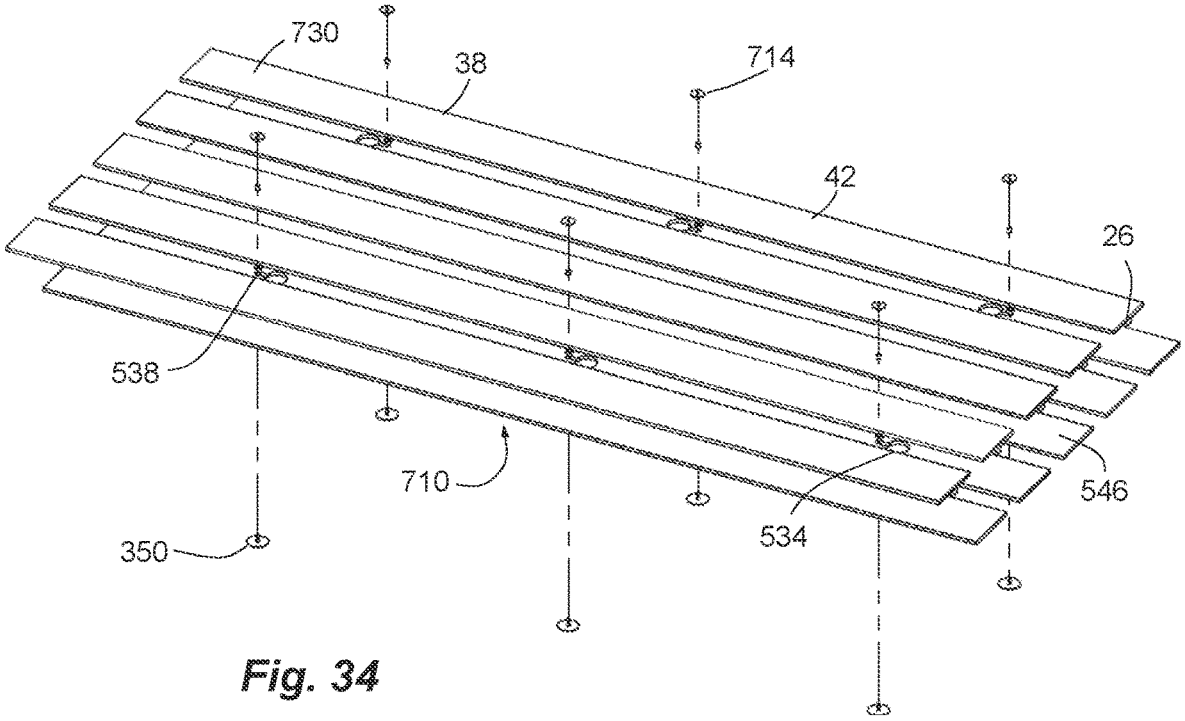
FIG. 34 is a perspective view of another subfloor with a subfloor anchor system in accordance with another aspect of the technology.
Figure 35:
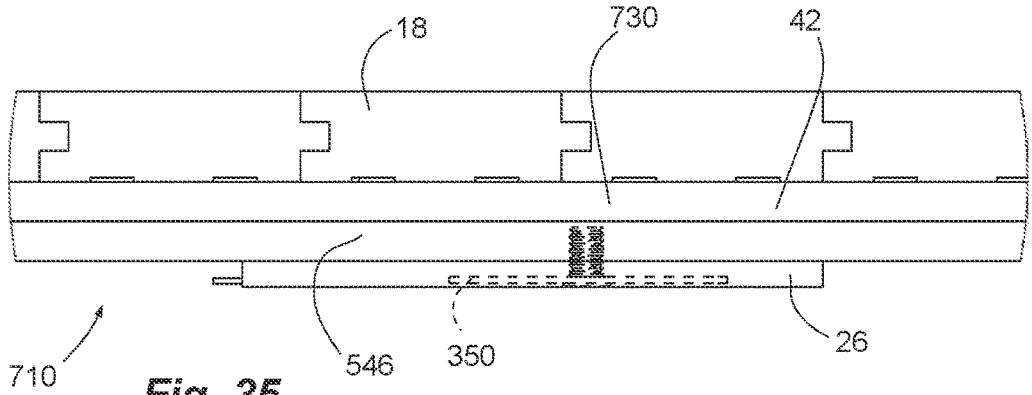
FIG. 35 is a side view of the subfloor of FIG. 34.

Referring to FIGS. 34-35, another subfloor 710 and another subfloor anchoring system 714 in accordance with an aspect of the technology are shown which are similar in structure and function to the above descriptions, and which descriptions are hereby incorporated herein. In one aspect, the subfloor anchoring system 714 can utilize adhesive anchors 350 as described above. The subfloor 710 can have openings, such as keyholes 534, in the frame 730, such as the lower arms or slats 546. In one aspect, the lower arms 546 and the upper arms 42 of the frame 730 can be oriented parallel with respect to one another. The lower arms 546 can be spaced-apart from one another, and the upper arms 42 can be spaced-apart from one another.

Figure 36:
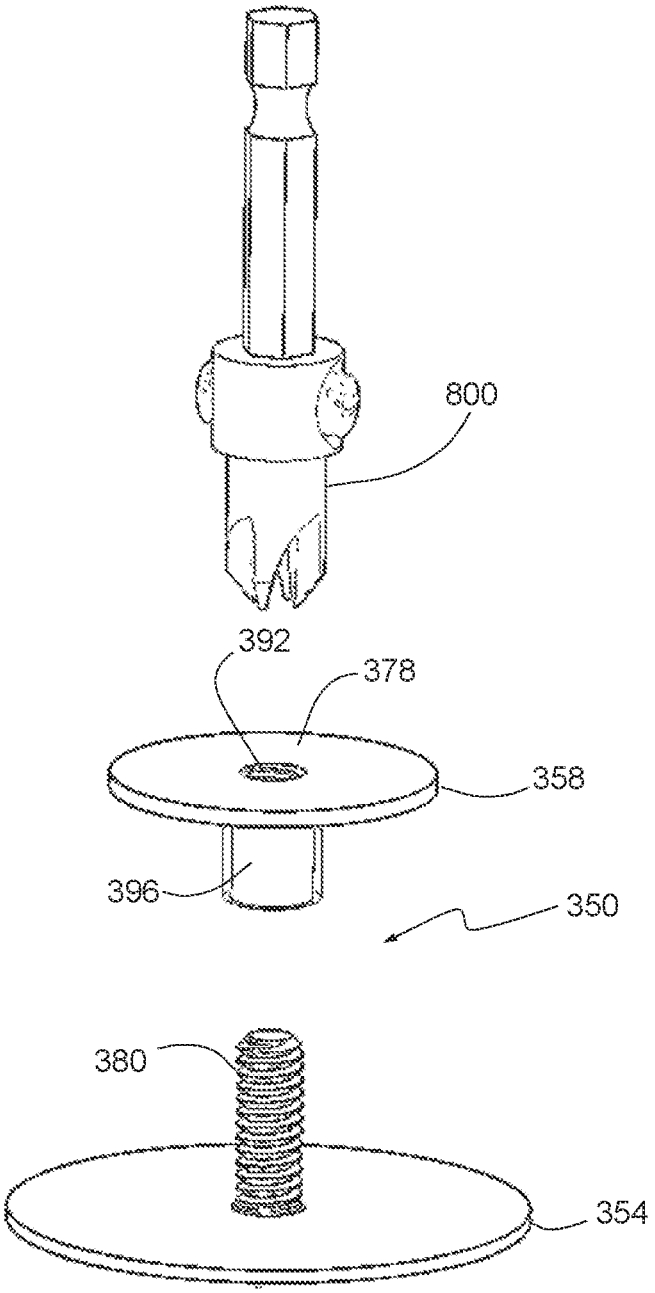
FIG. 36 is an exploded perspective view of a friction style drive tool in accordance with an aspect of the technology.

Referring to FIG. 36, a friction style drive tool 800 is shown for engaging the open top 392 of the adhesive pin 358 to advance the adhesive pin 358 with respect to the adhesive base 354. The drive tool 800 can resist over tightening. In one aspect, the drive tool 800 can comprise conical tip insertable into the threaded bore 388 of the adhesive pin 358 through the open top 392. In another aspect, the drive tool 800 can have a fluted tip with edges to engage the adhesive pin 358. In another aspect, the drive tool 800 can be coupled to a shaft and insertable into the chuck of a drill.

In use, a method for anchoring the subfloor comprises placing a frame carried by a resilient layer above a slab. An adhesive is applied to a bottom surface of an anchor base 354 of an adhesive anchor 350. The anchor base 354 is inserted in an opening, such as the slot 434 or keyhole 534, in the frame. The adhesive on the bottom surface of the anchor base 354 is adhered to the slab. An anchor pin 358 of the adhesive anchor 350 is attached to the anchor base 354. The anchor pin 358 is advanced towards the anchor base 354 until reaching a desired elevation of the frame with respect to the slab. In one aspect, the anchor base 354 can be slid into a slot 434 or 538 while maintaining an elevation of the anchor base 354 with respect to the slab, and then adhering the adhesive on the bottom surface of the anchor base 354 to the slab. In another aspect, a slot can be cut in a vapor retarder using a hook blade razor knife inserted through the aperture 34 of the keyhole 534 to allow access to the slab. The vapor retarder can be pulled up at the cut to allow access to insert the adhesive anchor 350, or the anchor base 354 thereof, through the cut so that the adhesive makes contact with the slab.

Figure 37:
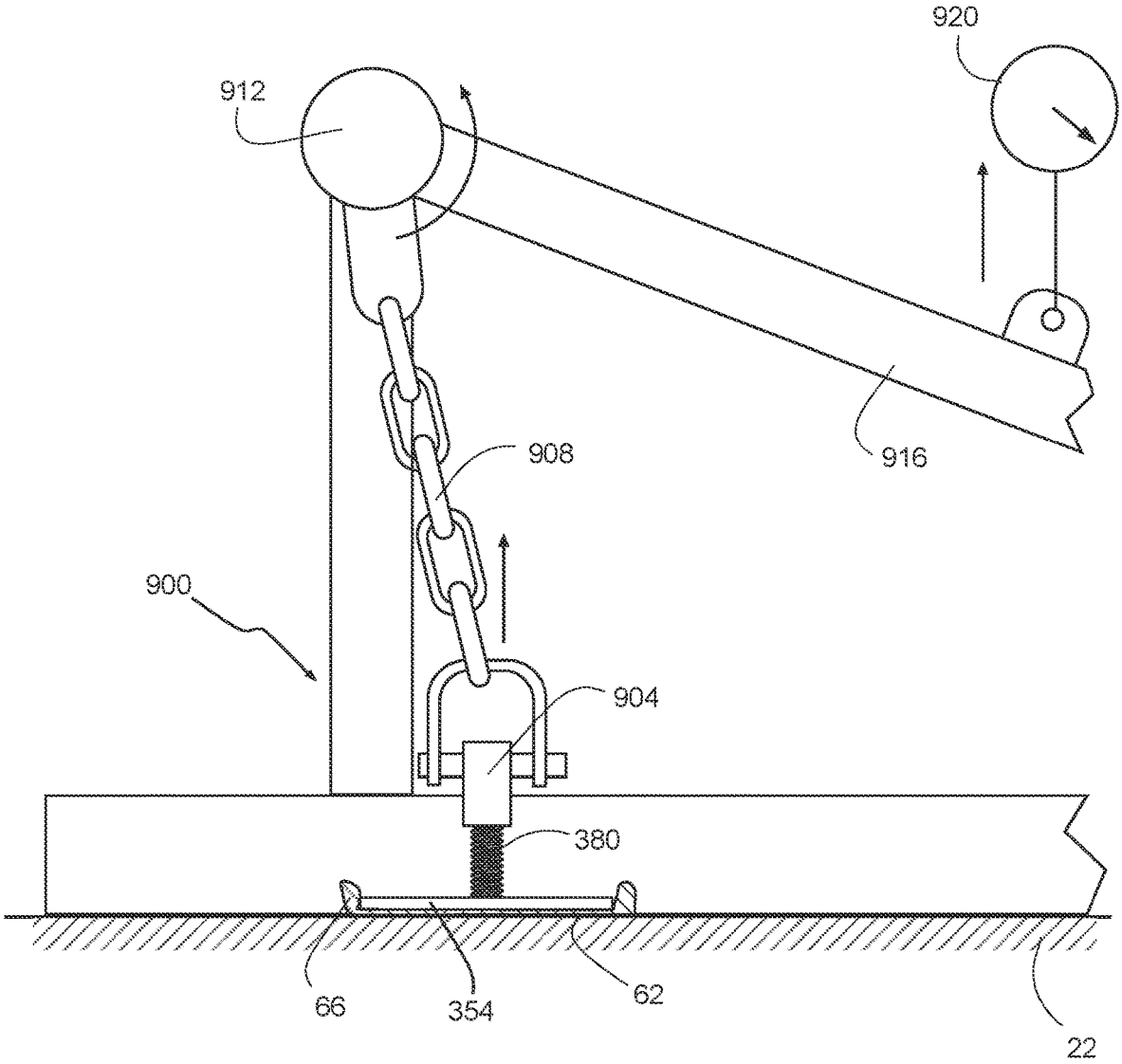
FIG. 37 is a side schematic view of a field test jig to perform site evaluation to determine suitability for site conditions in accordance with an aspect of the technology.

Referring to FIG. 37, in another aspect, a field test jig 900 can be used to perform a site evaluation to determine suitability of the adhesive bond to the site conditions, e.g. self-leveling concrete topping compound, topical applied concrete vapor retarder, etc. The jig 900 can have a threaded nut 904 to couple to the threaded stud 380 of the adhesive base 354. The threaded nut 904 can be coupled by a chain 908 to a pivot 912. In one aspect, the length of the chain 908 can be adjusted. A lever arm 916 can be coupled to the pivot 912. The lever arm 916 can be lifted to pivot the pivot 912 and pull the chain 908 to exert a lifting force on the threaded nut 904, and thus the anchor base 354. In one aspect, a force sensor or scale 920 can be coupled to the lever arm 916 to measure the force.

In another aspect, an installation kit can provide the tools and adhesive to install the adhesive anchors. The kit can comprise the adhesive anchors, adhesive, an adhesive applicator, mixing nozzles, drive tool, hook blade knife. The adhesive can comprise a dual-component epoxy.

Various aspects of the examples and embodiments described above and shown in the drawings can be combined with one another.

Example subfloors are described in U.S. Pat. Nos. 7,127,857 and 7,735,281 with are hereby incorporated herein by reference.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications, combination of features, or changes, if any, are intended to fall within the scope of the present technology as described and set forth herein. In addition, while specific features are shown or described as used in connection with particular aspects of the technology, it is understood that different features may be combined and used with different aspects. Numerous features from various aspects of the technology described herein may be combined in any number of variations as suits a particular purpose.

More specifically, while illustrative exemplary aspects of the technology have been described herein, the present technology is not limited to these aspects, but includes any and all aspects having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

What is claimed is:

1. A subfloor configured to support flooring with respect to a slab, the subfloor comprising:
- a resilient layer positionable over the slab;
- a frame carried by the resilient layer and suspendable above the slab by the resilient layer;
- openings in the frame, each opening comprising a slot extending from the aperture, the slot extending from a top surface to a bottom surface of the frame, the slot having a substantially continuous cross section extending from the top surface to the bottom surface; and
- adhesive anchors located in the openings, each adhesive anchor comprising:
  - an anchor base with a bottom surface and an adhesive applied to the bottom surface to adhere the anchor base to the slab;
  - an anchor pin received by the anchor base and having an enlarged head with a dimension larger than at least a portion of a respective opening; and
  - a threaded engagement between the anchor pin and the anchor base with the anchor base having a threaded insert, and the anchor pin having a threaded receiver, the anchor pin and the anchor base engaging rotationally.

2. The subfloor of claim 1, further comprising:
- each opening comprising an aperture in the frame and surrounded on all sides by the frame; and
- each anchor base having lateral dimensions less than lateral dimensions of a respective aperture with the anchor base being insertable through the respective aperture.

3. The subfloor of claim 2, wherein
- the slot has a width less than the lateral dimension of the aperture; and
- the enlarged head of each anchor pin has the lateral dimension larger than the width of the slot.

4. The subfloor of claim 3, further comprising:
- the frame comprising a lattice carried by the resilient layer, the lattice comprising:
  - an array of upper cross-arms carried by the resilient layer and suspendable above the slab by the resilient layer; and
  - an array of lower cross-arms coupled to and suspended from the array of upper cross-arms;
- the keyholes in the lower cross-arms; and
- one keyhole oriented with a corresponding slot extending one direction, and another keyhole oriented with another corresponding slot extending in another opposite direction.

5. The subfloor of claim 1, further comprising:
- each opening comprising a slot extending into the frame from a perimeter side of the frame; and
- the enlarged head of each anchor pin having the lateral dimension larger than a width of the slot.

6. The subfloor of claim 5, further comprising:
- the frame comprising a lattice carried by the resilient layer, the lattice comprising:
  - an array of upper cross-arms carried by the resilient layer and suspendable above the slab by the resilient layer; and
  - an array of lower cross-arms coupled to and suspended from the array of upper cross-arms, the array of upper cross-arms being oriented transverse to the array of lower cross-arms;

the slots in the lower cross-arms; and one slot extending into one side of the lower cross-arm, and another slot extending into another opposite side of the lower cross-arm.

7. The subfloor of claim 1, wherein each adhesive anchor further comprises:

a locking mechanism associated with the threaded engagement to resist rotation between the anchor pin and the anchor base, the locking mechanism comprising at least one of a lock washer, a deformable ring, a threadlock compound, and/or an insert, coating or thin tube between the threaded receiver and the threaded insert.

8. The subfloor of claim 1, wherein each adhesive anchor further comprises:

the anchor pin having a neck extending from the enlarged head and a threaded bore extending through the neck and the enlarged head defining the threaded receiver and an open top; and the anchor base having a threaded stud extending therefrom defining the threaded insert and received in the threaded bore of the anchor pin.

9. The subfloor of claim 8, wherein each adhesive anchor further comprises:

a sleeve circumscribing the neck of the anchor pin and being positioned in the opening between the neck of the anchor pin and the frame.

10. The subfloor of claim 8, wherein each adhesive anchor further comprises:

a riser between the threaded stud of the anchor base and the threaded bore of the anchor pin.

11. The subfloor of claim 8, wherein each adhesive anchor further comprises:

the ridged insert having vertical tabs arranged radially and radiating outwardly with respect to a center;

each vertical tab having a series of ridges with inclined surfaces facing upwardly, and opposite blunt surfaces facing downwardly;

the ridged receiver having vertical slots arranged radially and radiating outwardly with respect to a center, and corresponding to the vertical tabs of the ridged insert;

each vertical slot having a series of ridges with inclined surfaces facing downwardly, and opposite blunt surfaces facing upwardly; and each vertical slot having opposing walls that deflect outwardly to accommodate insertion of a corresponding vertical tab.

12. The subfloor of claim 1, wherein each adhesive anchor further comprises:

a mating saw-tooth engagement between the anchor pin and the anchor base with one of the anchor base and the anchor pin having a ridged receiver that is flexible and resilient, and the other of the anchor base and the anchor pin having a ridged insert, and the anchor pin and the anchor base engaging linearly.

13. The subfloor of claim 1, wherein each adhesive anchor further comprises:

the bottom surface of the anchor base having a series of concentric annular grooves configured to receive adhesive therein.

14. The subfloor of claim 1, further in combination with flooring supported above a slab by the subfloor, the combination comprising:

adhesive between each bottom surface of the anchor base and the slab, and adhering the frame to the slab with the adhesive anchors;

the frame being carried on the slab by the resilient layer;

an elevation of an upper surface of the frame with respect to the slab around each adhesive anchor being set by a corresponding adhesive anchor; and the flooring being carried by the frame.

15. A subfloor in combination with flooring supported above a slab by the subfloor, the combination comprising:

a matrix of resilient pads positioned over the slab;

a lattice carried by the matrix of resilient pads, the lattice comprising:

an array of upper cross-arms carried by the matrix of resilient pads and suspended above the slab by the matrix of resilient pads;

an array of lower cross-arms coupled to and suspended from the array of upper cross-arms;

openings in the lower cross-arms, each opening having a substantially continuous cross section extending from a top surface of the lower cross-arms to a bottom surface of the lower cross-arms; and adhesive anchors located in the openings, each adhesive anchor comprising:

an anchor base with a bottom surface having an adhesive adhering the anchor base to the slab and a threaded insert, the lateral dimension of the anchor base being less than the lateral dimension of the opening in the lower cross-arms; and an anchor pin received by the anchor base and having a threaded receiver and an enlarged head with a dimension larger than at least a portion of a respective opening;

wherein the anchor pin and the anchor base are engaged rotationally.

16. The subfloor of claim 15, further comprising:

each opening comprising a slot extending from an aperture defining a keyhole, the slot having a width less than the lateral dimension of the aperture;

the enlarged head of each anchor pin having the lateral dimension larger than the width of the slot; and one keyhole oriented with a corresponding slot extending one direction, and another keyholes oriented with another corresponding slot extending another opposite direction.

17. The subfloor of claim 15, further comprising:

each opening comprising a slot extending into at least one of the lower cross-arms from a perimeter side of at least one of the lower cross-arms;

the enlarged head of each anchor pin having the lateral dimension larger than a width of the slot; and one slot extending into one side of at least one of the lower cross-arms, and another slot extending into another opposite side of at least one of the lower cross-arms.

18. A method of anchoring a subfloor, the method comprising:

placing a frame carried by a resilient layer above a slab;

applying an adhesive to a bottom surface of an anchor base of an adhesive anchor;

inserting the anchor base in an opening in the frame, the opening having a substantially continuous cross section extending from a top surface of the frame to a bottom surface of the frame;

adhering the adhesive on the bottom surface of the anchor base to the slab;

attaching an anchor pin of the adhesive anchor to the anchor base; and advancing the anchor pin towards the anchor base until reaching a desired elevation of the frame with respect to the slab;

wherein the anchor base and anchor pin define a threaded engagement, with the anchor base having a threaded insert and the anchor pin having a threaded receiver, the anchor pin and anchor base engaging rotationally.

19. The method of claim 18, further comprising:

sliding the anchor base into a slot while maintaining an elevation of the anchor base with respect to the slab, and then adhering the adhesive on the bottom surface of the anchor base to the slab.

* * * * *